United States Patent [19]

Small

[11] 4,112,956

[45] Sep. 12, 1978

[54] SHELTER CONSTRUCTION AND METHOD OF ASSEMBLING SAME

[76] Inventor: William H. Small, 7256 S. Coles, Chicago, Ill. 60649

[21] Appl. No.: 743,874

[22] Filed: Nov. 22, 1976

[51] Int. Cl.[2] ..... A45F 1/12; A45F 1/16

[52] U.S. Cl. ..... 135/1 D; 52/83; 135/15 PQ; 135/15 CF; 135/DIG. 12

[58] Field of Search ..... 135/1 D, DIG. 9, DIG. 12, 135/3 C, 4 B, 15 PE, 15 CF, DIG. 8, 15 PQ; 52/63, 83, 745, 749, 4, 23, 80, 81, 82

[56] References Cited

U.S. PATENT DOCUMENTS

| | | | |
|---|---|---|---|
| 2,168,428 | 8/1939 | Mellor | 135/15 CF |
| 2,335,648 | 11/1943 | Coleman | 135/15 CF |
| 2,497,596 | 2/1950 | Frieder et al. | 135/15 CF |
| 2,677,384 | 5/1954 | Luisada | 135/3 |
| 2,715,757 | 8/1955 | Litwinski | 135/1 D |
| 3,365,855 | 1/1968 | Vermette | 52/749 |
| 3,372,430 | 3/1968 | Lowes | 52/749 X |
| 3,412,426 | 11/1968 | O'Dell, Jr. | 52/749 |

FOREIGN PATENT DOCUMENTS

| | | | |
|---|---|---|---|
| 115,871 | 9/1942 | Australia | 52/80 |

*Primary Examiner*—Werner H. Schroeder
*Assistant Examiner*—Conrad L. Berman
*Attorney, Agent, or Firm*—Bernard L. Kleinke

[57] ABSTRACT

A shelter construction includes a series of upstanding posts secured to the ground, and a group of tensile lines interconnecting the upper portions of the posts for supporting a thin flexible sheet of imperforate material overlying the group of tensile lines. The sheet is attached to the tensile lines, and the periphery of the sheet is fixed to the ground. The posts are arranged in a plurality of concentric imaginary rings, and they are of different heights with groups of the posts of substantially the same height being arranged along the same rings and being arranged with posts of progressively shorter heights along the rings with progressively increasing radii to enable the shelter to assume a dome shape. In order to facilitate the assembling of the shelter, a protracting tool having a circular face plate graduated in equally angularly spaced markings about the periphery thereof is positioned at the desired center location of the shelter so that a measuring tape having graduated markings thereon can be attached with its end to the center of the face plate. The tape is then positioned over successive ones of the angularly spaced markings so that the posts may be positioned opposite predetermined ones of the markings on the tape with one of the posts being disposed at the center location.

11 Claims, 7 Drawing Figures

FIG. 1
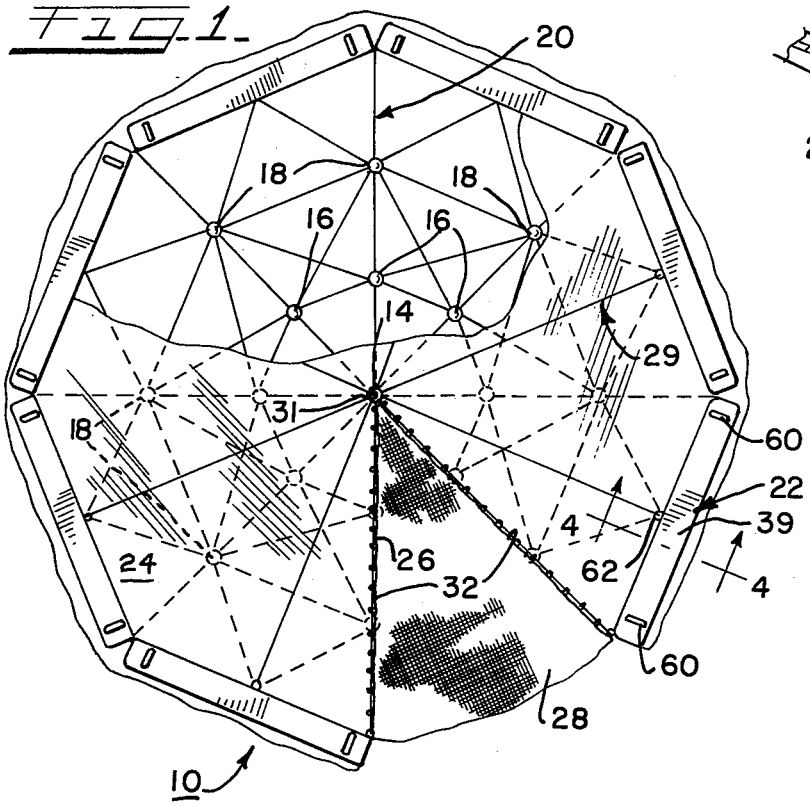
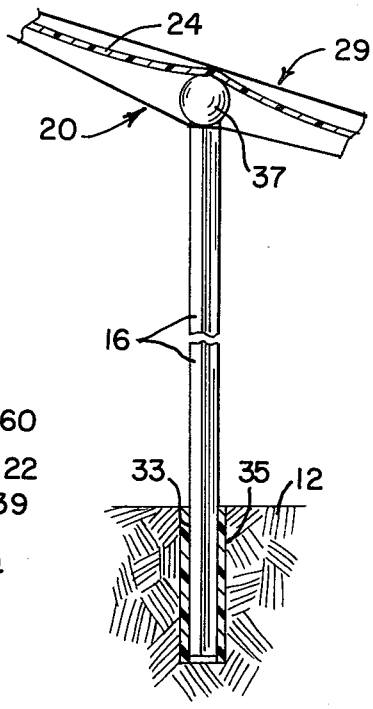
FIG. 3
FIG. 2
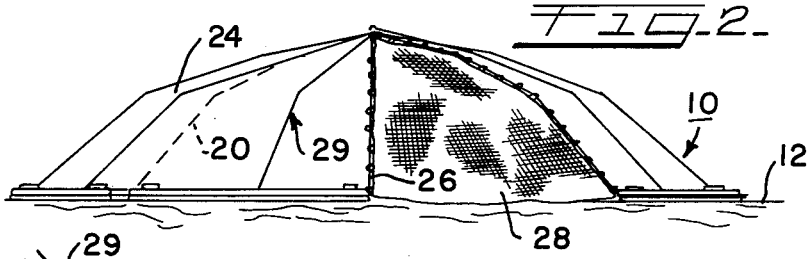
FIG. 5
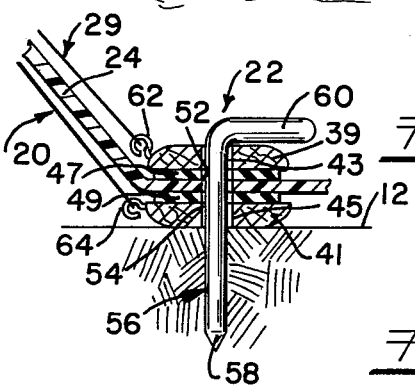
FIG. 4
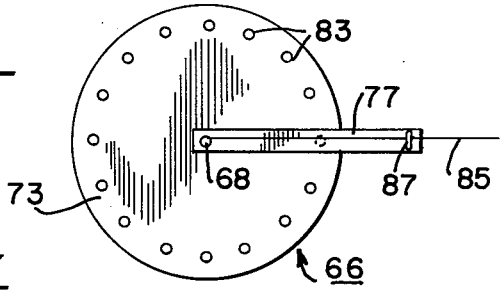
FIG. 7
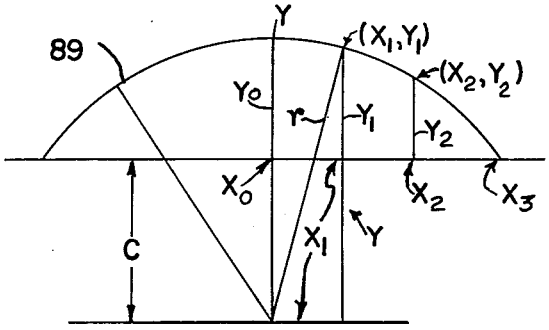
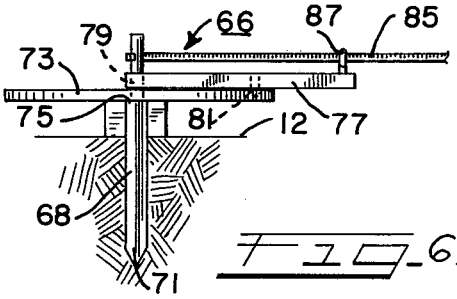
FIG. 6

SHELTER CONSTRUCTION AND METHOD OF ASSEMBLING SAME

The present invention relates in general to a shelter construction and a method of assembling it, and it more particularly relates to a shelter construction of a light weight inexpensive type, together with the method of assembling it.

Many different types and kinds of light weight inexpensive building constructions have been employed. For example, reference may be made to the following U.S. Pat. Nos. 2,677,384; 2,748,785; 3,710,806 and 3,888,056. While such types and kinds of building constructions may be satisfactory for some applications, it would be highly desirable to have a building construction which is even lighter in weight and much less expensive. Also, such a new type of building construction should be of the type that can be readily assembled so that the building can be used as a shelter that can be used as a greenhouse or other such purposes. While being light in weight, it should be able to withstand a substantial wind load, and it should have no need for heavy wooden beams or expensive aluminum beams. Also, it should be adaptable for many different sizes.

Therefore, the principal object of the present invention is to provide a new and improved shelter construction and a method of assembling it wherein the resulting shelter construction is very light in weight and very inexpensive to manufacture.

Another object of the present invention is to provide such a new and improved shelter construction and method of assembling it wherein the resulting shelter construction is able to withstand substantial wind loading without the necessity of heavy wooden beams or expensive aluminum beams.

Briefly, the above and further objects of the present invention are realized by providing a shelter construction which includes a series of upstanding posts secured to the ground and a group of tensile lines interconnecting the upper portions of the posts. A thin flexible sheet of imperforate material overlies and is attached to the tensile lines, the periphery of the sheet being fastened to the ground. The posts are arranged in a plurality of concentric imaginary rings, said posts being of different heights with groups of said posts of substantially the same height arranged along the same rings, said posts of progressively shorter heights being arranged along said rings with progressively increasing radii to enable the shelter to assume a dome shape. The dome shape enables the shelter to have a maximum amount of interior space for a given size flexible sheet.

The invention, both as to its organization and method of operation, together with further objects and advantages thereof will best be understood by reference to the following detailed description taken in connection with the accompanying sheet of drawings, wherein:

FIG. 1 is a fragmentary plan view of a shelter which is constructed in accordance with the present invention;

FIG. 2 is an elevational view of the shelter of FIG. 1;

FIG. 3 is a vertical cross-sectional fragmentary view of one of the support posts of the shelter of FIG. 1;

FIG. 4 is a cross-sectional view of a clamp portion of the shelter of FIG. 1 taken substantially along the line 4—4 thereof;

FIG. 5 is a plan view of a tool used in assembling the shelter of FIG. 1;

FIG. 6 is an elevational view of the tool of FIG. 5; and

FIG. 7 is a diagram useful in determining the location of the support posts of the shelter of FIG. 1 for assembling it.

Referring now to the drawings, and more particularly to FIGS. 1, 2, 3 and 4 thereof, there is shown a dome-shaped shelter 10, which is constructed in accordance with the present invention and which is mounted above the ground 12. A series of upstanding support posts are arranged along a plurality of concentric imaginary rings to enable the shelter 10 to assume a dome shape which maximizes the interior space of the shelter 10. The posts include a center post 14, a series of longer posts 16 arranged along an imaginary ring surrounding the center post 14, and a series of shorter posts 18 arranged along an imaginary ring surrounding the ring of longer posts 16. The posts are thus of different heights with groups of the posts of substantially the same height arranged along the same imaginary rings, the posts of progressively shorter heights being arranged along rings with progressively increasing radii to enable the shelter to be of a dome shape.

An inner network or group of tensile members or lines 20 in the form of flexible cords are tied to and interconnect the upper portions of the support posts as hereinafter described in greater detail. A series of hold-down clamps 22 are secured to the peripheral edges of a flexible plastic sheet 24 disposed in overlying engagement with the inner network or group of tensile members 20. A triangular door opening 26 in the flexible sheet 24 permits access to the interior of the shelter 10, and a flexible triangular door 28 is removably secured over the opening 26. An outer network or group of tensile members or lines 29 are stretched between a ring 31 positioned at the center of the sheet 24 over the center post 14 and the center portions of the hold-down clamps 22 to secure the sheet 24 to the inner network of tensile members 20. The door 28 may be preferably composed of a mosquito netting material to provide for ventilation to the interior of the shelter 10 and may be conveniently secured to a pair of outer tensile members 29 by means of a series of rings 32, whereby the flexible door 28 can be slid upwardly to gain access to the interior of the shelter 10.

Considering now the posts in greater detail with reference to FIG. 3 of the drawings, one of the longer posts 16 will now be considered in greater detail, it being understood that the shorter posts 18 are similar to the longer posts 16. It should also be understood by those skilled in the art that any number of concentric imaginary rings of posts may be employed depending upon the size of the desired shelter. A plastic sleeve 33 is imbedded in the ground 12 for receiving the lower end portion of the post 16 for supporting it in place. As a result, in order to disassemble the shelter 10, the posts may merely be slid out of the sleeves and the sleeves may be permitted to remain in the ground. As a result, the shelter 10 may be disassembled and then subsequently reassembled at a later date by merely slipping the poles into the sleeves still remaining in the ground. Thus, for example, when the shelter 10 is used as a greenhouse, the shelter can be disassembled and remain in storage during the winter months and then reassembled during the warm weather months in a convenient manner. Thus, during the initial assembly of the shelter 10, it is only necessary to dig the holes, such as the hole 35, in the ground, and then the plastic sleeves are then inserted into the holes so that the sleeves can remain there even when the shelter 10 is subsequently disassembled.

The post 16 includes a knob or enlarged end 37 at the upper portion thereof so as not to tear or damage the flexible plastic sheet 24 resting thereon. The inner flexible line or cord 20 is tied to the upper portion of the post 16 immediately under the knob 37.

Considering now the hold-down clamps 22 in greater detail with reference to the drawings, and more particularly to FIG. 4 thereof, the hold-down clamps are all generally similar to one another, and they include a pair of strips 39 and 41 which are disposed in overlying relationship relative to one another with a peripheral end portion of the sheet 24 disposed therebetween. A pair of aligned holes 43 and 45 in one end portion of the respective strips 39 and 41 are each aligned with a pair of aligned holes 52 and 54 extending through a pair of resilient pads 47 and 49, respectively, secured to the confronting faces of the respective strips 39 and 41 for gripping the peripheral edge portion of the sheet 24. A stake 56 extends through the two pairs of aligned holes in the strips and the resilient pads to secure them to the ground 12, the stake 56 having a pointed end 58 being driven into the ground. A laterally-extending bent handle portion 60 overlies the upper surface of the upper strip 39 when the stake 56 is driven into the ground through the strips and resilient pads. As shown in FIG. 1 of the drawings, there is a pair of similar stakes which are used at opposite ends of the strips.

A screw eye 62 is driven into the mid-portion of the upper strip 39 for receiving one of the tensile members 29 to tension it between the strip 39 and the ring 31. As shown in FIG. 4 of the drawings, a screw eye 64 is driven into the lower strip 41 to enable a pair of inner network tensile members 20 to be fastened thereto for tensioning purposes, whereby the inner tensile members 20 are tensioned between the lower strip 41 and shorter posts 18.

Considering now the method of assembling the shelter 10, with particular reference to FIGS. 5, 6 and 7 of the drawings, there is shown in FIGS. 5 and 6 a protracting tool 66 which is useful in the assembly of the shelter 10 as hereinafter described in greater detail, FIG. 7 illustrating a chart which is useful in connection with the protracting tool 66 to determine the spacing of the posts and their heights above ground level. Considering firstly the protracting tool 66, the tool 66 includes a stake 68 which has a pointed end 71 depending from a centrally apertured circular face plate 73 which fits over the upper portion of the stake against a shoulder 75 thereon. A bar or arm 77 has a hole 79 at one end thereof which fits over and loosely receives the upper portion of the stake 68 above the face plate 73 to freely revolve about the stake 68, the arm 77 extending radially from the center of the face plate outwardly beyond the periphery of the face plate 73. A depending pin 81 extending from the underside of the arm 77 intermediate its ends fits into a series of equally angularly spaced holes or recesses 83 in the face plate 73, whereby the pin 81 fits into and cooperates with the holes 83 to serve as a detent means so that the arm 77 can be moved sequentially angularly from one angular position to the next. A tape measure 85 or other similar device is connected at one of its ends to the upper portion of the stake 68 and then extends along the arm 77 and fits under a hook 87 at the free distal end portion of the arm 77.

In order to determine where the posts are to be inserted into the ground, the tape measure 85 is connected at one of its ends to the stake 68 and extends along the arm 77 under the hook 87 and is then stretched outwardly in a straight line so that the distance from the center of the face plate 73 may be measured and the longer post 16 and the shorter post 18 spaced apart at the appropriate positions along the tape measure. Similarly, the positions of the hold-down clamps 22 may also be determined by measuring the position thereof with the graduated markings on the tape measure 85. The arm 77 is then rotated about the stake 68 to the next adjacent hole 83 for receiving the pin 81. Thereafter, the positions for the next pair of shorter and longer posts and another portion of the same hold-down clamp 22 (or the next hold-down clamp as the case may be).

This procedure of moving the arm 77 sequentially from one hole 83 to the next determines the positions of the posts and hold-down clamps. The shorter and longer posts are then driven into the ground in an equally spaced-apart manner along a pair of concentric imaginary rings about the center post 14 which may be driven into the position of the stake 68 after the protracting tool 66 is removed from the ground. Thereafter, the inner network or group of tensile members 20 in the form of flexible Nylon cords are tied to the upper portions of the posts as shown in FIGS. 1 and 3 of the drawings. The lower ends of the tensile members 20 are attached to the screw eyes 64 of the lower strip 41 of the hold-down clamps 22. In this regard, it should be understood that initially, only the lower strip 39 is fastened to the ground by the stakes 56 so that the lower ends of the tensile members 20 may be secured to the lower strips 39 for tensioning purposes.

The circular flexible sheet 24 is then placed in overlying relationship with the inner network of tensile members 20, and the peripheral edge portion of the sheet 24 is then attached to the ground by the hold-down clamps 22. For this purpose, the stakes 60 must first be removed from the lower strip 41 while maintaining it in position to retain the tension on the tensile members 20. Thereafter, the end portion of the sheet 24 is placed over the lower strip 41 and the upper strip 39 is placed above the sheet 24 directly above the lower strip 41. As a result, the stakes 60 may be inserted through the aligned holes in the strips 39 and 41 to punch a hole through the sheet 24 by means of the pointed end 58 of the stake 60. The stake 60 is then forced through the hole 45 in the lower strip 41 and then into the ground to secure the sheet 24 to the ground and to maintain the tension on the tensile members 20.

In order to secure the sheet 24 to the inner network of tensile members 20, the ring 31 is placed at the center uppermost portion of the sheet 24 over the upper portion of the center post 14 above the sheet 24. The outer network or group of tensile members 29 are then tied at their upper ends to the ring 31 and at their lower ends to the screw eye 62 extending from the upper strip 39 of the hold-down clamp 22. It should be noted that the outer tensile members 29 in the form of Nylon cord are not tensioned to the same extent as the inner network of tensile members since they need only be able to provide additional support for the sheet since the sheet 24 is secured tightly over the inner network of tensile members 20 and tightly secured to the ground by means of the hold-down clamps 22. The door 28 can be secured over the door opening 26 in any convenient manner by attaching the door rings 32 to a pair of inner tensile members 20.

Considering now the method of determining the heights of the longer and shorter posts and the radii of the concentric rings along which the posts are spaced, as well as the radius of the imaginary ring along which the hold-down clamps are spaced, as shown in FIG. 7 of the drawings, the configuration of the shelter 10 is shown graphically by the curved line segment 89 which illustrates the shape of the outer configuration of the dome-shaped shelter, the X axis representing ground level. The line designated *r* indicates the radius of curvature of the shelter, and the Y axis is used to determine the height of the posts above ground level. The dimension *c* shows the distance below ground level to the point which is the center of an imaginary circle of which the distance *r* is the radius, the curved line 89 forming a segment of that imaginary circle. The distance along the X axis shows the radii of the imaginary rings along which the posts may be posted.

The following is a series of algebraic equasions for determining the relationship between the height of the posts above ground level and the radii of the imaginary rings:

$$r^2 = X^2 + Y^2$$

$$X^2 = r^2 - Y^2$$

$$X^2 = r^2 - Y_1 - c$$

*X* is the radius of a given ring, $Y_o$ is the height of the post above ground, *r* is the radius of curvature of the resulting dome shape, and *c* is the distance between the ground level and the center point for the radius of curvature. The first equasion is a basic equasion for the circle derived from the relationship of a right triangle. In using the last equasion mentioned above, the radii of the rings are determined by selecting desired values for *r*, *c* and $X_o$. The following is an example of how the shelter may be constructed:

| | Radius | Height (above grade) | Overall Length |
|---|---|---|---|
| $X_o$ | 0—0 | 8' 0" | 10' 0" |
| $X_1$ | 6' 0" | 7' 0" | 9' 0" |
| $X_2$ | 12' 0" | 4' 0" | 6' 0" |
| $X_3$ | 16' 0" | — | — |

It should become apparent to those skilled in the art that various different sizes of shelters or buildings may be constructed by providing fewer or greater number of supporting posts. Also, the outer profile of the dome-shaped shelter may be adjusted by assuming different values for the constant *c* shown in FIG. 7.

While the present invention has been described in connection with a particular embodiment thereof, it will be understood that many changes and modifications of this invention may be made by those skilled in the art without departing from the true spirit and scope thereof. Accordingly, the appended claims are intended to cover all such changes and modifications as fall within the true spirit and scope of the present invention.

What is claimed is:

1. A shelter construction, comprising:

a series of upstanding posts adapted to be secured in the ground;

a group of tensile lines interconnecting directly the upper portions of said posts;

a single thin flexible sheet of imperforate material overlying and at least partially being supported from below by said group of tensile lines, said sheet being untensioned and resting on top of said posts and said tensile lines;

fastening means for fixing the periphery of said sheet to the ground; and securing means for holding down loosely said sheet to confine the sheet in place over said tensile lines and the top portions of the posts.

2. A shelter construction according to claim 1, wherein said posts are arranged along a plurality of concentric imaginary rings, said posts being of different heights with groups of said posts of substantially the same height arranged along the same rings, said posts of progressively shorter heights being arranged along said rings with progressively increasing radii to enable said shelter to assume a dome shape.

3. A shelter construction according to claim 2, wherein one of the posts is disposed in the center, the height of the posts and the spacing thereof from the center post being arranged according to the mathematical formula: $X^2 = r^2 - Y_1 - c$, where *X* is the radius of said ring, $Y_1$ is the height of the longest post above the ground, *r* is the radius of curvature of the resulting dome shape and *c* is the distance between the ground level and the center point for said radius of curvature, the radii of said rings being determined by selecting desired values for *r*, *c* and $Y_1$.

4. A shelter construction according to claim 1, wherein said securing means includes a second group of tensile lines overlying said sheet.

5. A shelter construction according to claim 4, wherein said fastening means includes a series of clamping devices attached to the periphery of said sheet, said clamping devices each including a pair of spaced-apart oppositely-disposed members for receiving and engaging a peripheral portion of said sheet therebetween, said members having aligned openings extending therethrough, a stake extending through said openings and driven into the ground, the distal ends of said second group of tensile members being fixed to said clamping devices.

6. A shelter construction according to claim 4, wherein each one of said tensile members includes a flexible cord.

7. A shelter construction according to claim 6, further including a doorway opening in said sheet, a flexible triangularly-shaped door being removably attached over said doorway, wherein each one of said posts including an enlarged upper end portion thereof, a sleeve adapted to be disposed in a hole in the ground receiving removably the lower end portion of said post, a ring fitting over the center portion of said sheet over the center one of said posts and being connected to the upper end portions of said second groups of tensile members.

8. A method of assembling a shelter, comprising:

securing a group of posts in the ground in an upright manner and arranging them in concentric circles;

tying a group of tensile lines to the upper portions of said posts and tensioning them;

providing a single thin flexible generally-circular sheet;

positioning said sheet in overlying relationship with said lines to support at least partially said sheet in an untensioned manner from below by permitting said sheet to rest on top of said tensile lines;

fastening the periphery of said sheet to the ground; and holding down loosely said sheet to confine the sheet in place over said tensile lines and the top portions of said posts.

9. A method according to claim 8, further including arranging said posts along a plurality of concentric imaginary rings, the posts of similar heights being arranged along common ones of said rings, said posts being of different heights with groups of said posts of substantially the same height arranged along the same rings and being arranged with posts of progressively shorter heights along said rings with progressively increasing radii to enable said shelter to assume a dome shape.

10. A method according to claim 8, providing a protracting tool having a circular face plate graduated in equally angularly spaced markings about the periphery thereof, positioning said tool at the desired center location of the shelter, providing a measuring tape having graduated markings thereon, attaching the end of the tape to the center of said face plate, positioning the tape over successive ones of said angularly spaced markings and positioning said posts opposite predetermined ones of said markings on said tape and one of them at said center location.

11. A method according to claim 10, wherein said tool includes a stake depending from said face plate, driving said stake into the ground at said center location, said tool including a swivally connected arm having detent means thereon at said successive angular ones of said angularly spaced markings, moving said arm sequentially to said successive angular ones of said markings as determined by said detent means, said arm having tape attaching means thereon, connecting the end portion of said tape to said arm and then aligning said tape therewith.

* * * * *